US010627733B2

(12) United States Patent
Fujisaki et al.

(10) Patent No.: US 10,627,733 B2
(45) Date of Patent: Apr. 21, 2020

(54) IMAGE FORMING METHOD

(71) Applicant: Konica Minolta Inc., Tokyo (JP)

(72) Inventors: Tatsuya Fujisaki, Hino (JP); Ami Motohashi, Hachioji (JP); Takaki Kawamura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/163,090

(22) Filed: Oct. 17, 2018

(65) Prior Publication Data

US 2019/0187577 A1 Jun. 20, 2019

(30) Foreign Application Priority Data

Dec. 14, 2017 (JP) ..... 2017-239383

(51) Int. Cl.

| | |
|---|---|
| ***G03G 9/097*** | (2006.01) |
| ***G03G 13/08*** | (2006.01) |
| ***G03G 9/087*** | (2006.01) |
| ***G03G 9/08*** | (2006.01) |

(52) U.S. Cl.

CPC ..... *G03G 13/08* (2013.01); *G03G 9/0819* (2013.01); *G03G 9/0823* (2013.01); *G03G 9/08711* (2013.01); *G03G 9/08722* (2013.01); *G03G 9/08724* (2013.01); *G03G 9/08755* (2013.01); *G03G 9/08795* (2013.01); *G03G 9/08797* (2013.01); *G03G 9/09708* (2013.01); *G03G 9/08782* (2013.01)

(58) Field of Classification Search

None

See application file for complete search history.

(56) References Cited

U.S. PATENT DOCUMENTS

2018/0217517 A1* 8/2018 Fujisaki ..... G03G 9/08755

FOREIGN PATENT DOCUMENTS

JP 2007086494 A 4/2007

* cited by examiner

*Primary Examiner* — Peter L Vajda

(74) *Attorney, Agent, or Firm* — Lucas & Mercanti, LLP

(57) ABSTRACT

Provided is an image forming method using an electrostatic image developing toner containing: toner mother particles including a binder resin; and an external additive, wherein the binder resin contains a vinyl resin in an amount of 40 mass % or more with respect to the total amount of the binder resin, the image forming method including a step of: forming an image so that an image surface resistance value at 70° C. by a temperature change method of the formed image is set to be $5\times10^{13}$ Ω or less.

10 Claims, 3 Drawing Sheets

IMAGE FORMING METHOD

Japanese Patent Application No. 2017-239383, filed on Dec. 14, 2017 with Japan Patent Office, is incorporated herein by reference in its entirety.

TECHNICAL FIELD

The present invention relates to an image forming method. Particularly, the present invention relates to an image forming method capable of suppressing electrostatic adhesion between sheets after image formation.

BACKGROUND

In the past, in order to realize reduction of power consumption, speed up of printing, enlargement of applicable types of paper, attention has been drawn to a toner for developing an electrostatic image (hereinafter also simply referred to as a toner) which is excellent in low-temperature fixability for fixing a toner image on a recording medium such as paper at a lower temperature than before.

As a means for improving the low-temperature fixability of the toner, a method in which a crystalline substance is contained in a binder resin may be mentioned. When a crystalline substance is contained, the volume resistivity of the toner lowers and the changeability of the toner tends to deteriorate.

Toward this problem, a technique has been proposed in which a specific structure is introduced into the toner to increase the volume resistivity so as not to impair the chargeability of the toner even if a crystalline resin is contained (for example, refer to Patent document 1: JP-A 2007-86494).

Here, in the production print area, there are many cases where the toner adhesion amount is large and an image over the entire paper is output to both sides of the paper. The problem that documents are stuck to each other electrostatically at the time of paper ejection has become obvious. This is caused as follows. When outputting images on both sides, due to the transfer current at the time of transferring the toner image (hereinafter also referred to as the back side image) to the second side (back side) of the paper, the charge is accumulated in an image (hereinafter, also referred to as a surface image) fixed on the first side (front side) of the paper. Normally, when a rear side image on a sheet is fixed, the surface image and the pressure roller of the fixing device come into contact with each other, and the charge leaks. When sufficient heat is not applied to the surface image during fixing, the electric charge remains on the surface image.

According to the technique described in Patent Document 1, since the volume resistivity of the toner at the time of heating is high, electric charge tends to accumulate in the surface image, and there is a problem that adhesion between the sheets easily occurs.

SUMMARY

The present invention was done based on the above-described problems and situations. An object of the present invention is to provide an image forming method capable of suppressing electrostatic adhesion between sheets after image formation.

In order to solve the above-mentioned problem according to the present invention, the cause of the above problem was investigated. As a result, electrostatic adhesion between sheets after image formation can be suppressed by an image forming method using an electrostatic image developing toner containing: toner mother particles including a binder resin; and an external additive, wherein the binder resin contains a vinyl resin in a predetermined amount or more. This image forming method contains a step of forming an image so that an image surface resistance value at 70° C. by a temperature change method of the formed image is set to be not more than a predetermined value.

Namely, the object of the present invention is solved by the following embodiments.

An image forming method reflecting one aspect of the present invention is an image forming method using an electrostatic image developing toner containing: toner mother particles including a binder resin; and an external additive, wherein the binder resin contains a vinyl resin in an amount of 40 mass % or more with respect to the total amount of the binder resin, the image forming method comprising a step of:

forming an image so that an image surface resistance value at 70° C. by a temperature change method of the formed image is set to be $5\times10^{13}$ Ω or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
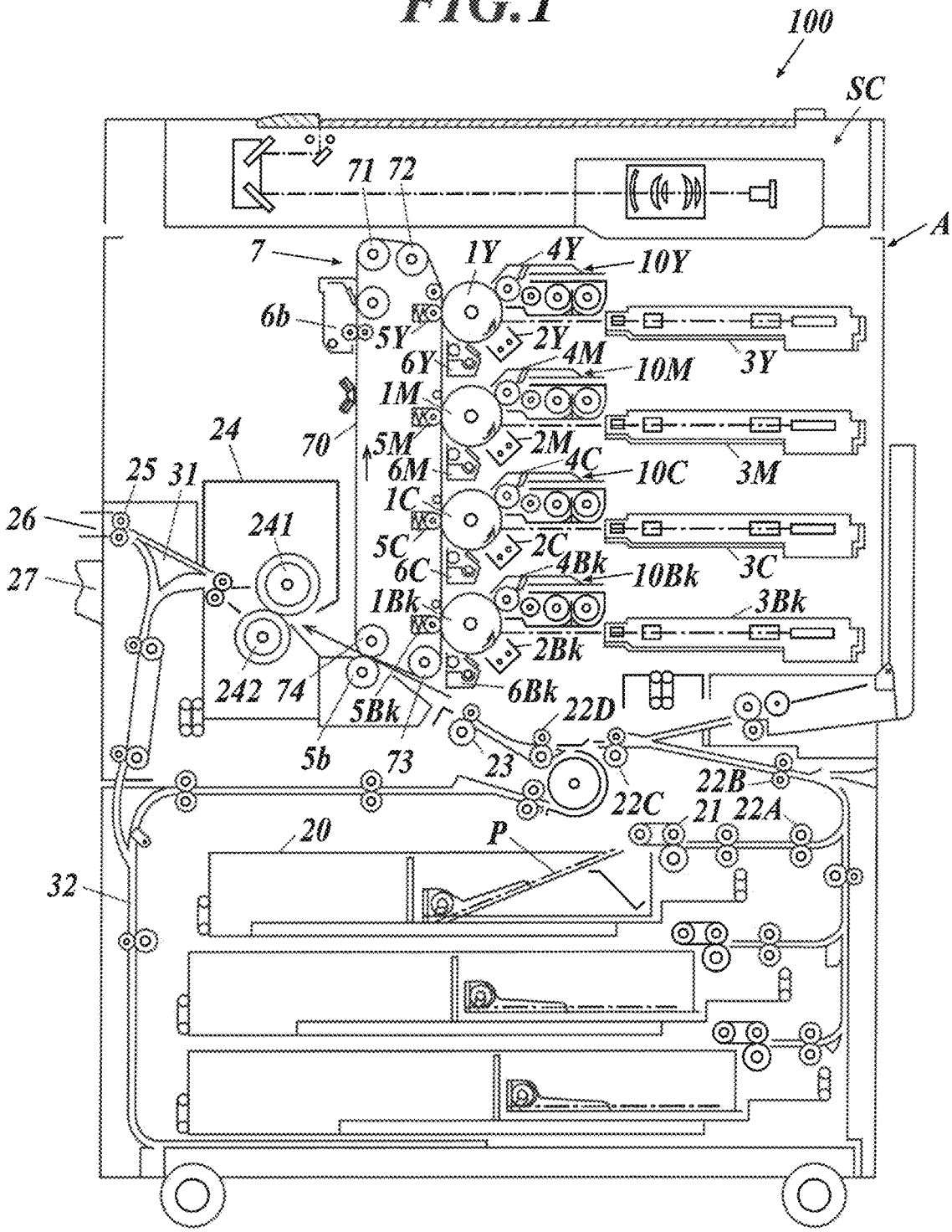
FIG. 1 is a schematic constitutional diagram illustrating an example of an image forming apparatus according to the present invention.

Hereinafter, one or more embodiments of the present invention will be described with reference to the drawings. However, the scope of the invention is not limited to the disclosed embodiments.

According to the present invention, it is possible to more reliably suppress electrostatic adhesion between sheets after image formation.

An expression mechanism or an action mechanism of the effects of the present invention is not clearly identified, but it is supposed as follows.

When an electric charge accumulates in the surface image due to the transfer current when transferring the toner image to the second side (back side) of the sheet at the time of double-sided printing, and the charge does not escape even if the surface image touches the pressure roller of the fixing device, electrostatic adhesion between sheets occurs. That is, the charge of the front side image is charged in the transfer step for the second side and moved by heating in the fixing step for the second side. Here, when the electric resistance value of the toner layer which is the surface image is small, the electric charge accumulated in the surface image is liable to move, so that no charge remains in the surface image after the image formation on the second surface, and it is thought that electrostatic adhesion does not occur. On the other hand, when the electric resistance value of the toner layer which is a front side image is large, it is considered that electrostatic adhesion occurs because charges are hard to move in the fixing step for the second side. Therefore, in the present invention, by forming an image so that the image surface resistance value at 70° C. measured with a temperature change method of the formed image is not more than a specific value, an electric charge is more likely to escape from the surface image in contact with the pressure roller in the fixing step for the second surface in double-sided printing. As a result, it is thought that electrostatic adhesion is suppressed.

An image forming method of the present invention is a method of using an electrostatic image developing toner containing: toner mother particles including a binder resin; and an external additive, wherein the binder resin contains a vinyl resin in an amount of 40 mass % or more with respect to the total amount of the binder resin, the image forming method comprising a step of: forming an image so that an image surface resistance value at 70° C. by a temperature change method of the formed image is set to be $5\times10^{13}$ Ω or less. This feature is a technical feature common or corresponding to the following embodiments.

In the present invention, it is preferable that a content of particles in the external additive having a number average primary particle diameter of 30 nm or less is 4 mass parts or more with respect to 100 mass parts of the toner mother particles. Thereby, in the layer of the formed image, external additives are continuously present at the interface between the toner base particles to result in more surely forming a conduction path through which charges can move, it is possible to more reliably suppress electrostatic adhesion between sheets of paper after the image formation.

In the present invention, it is preferable that among the particles in the external additive having a number average primary particle diameter of 30 nm or less, a content of particles having a volume resistivity of $1\times10^{10}$ Ω·cm or less is in the range of 30 to 100 mass % with respect to the whole external additive having a number average primary particle diameter of 30 nm or less. Thereby, the electric resistance value of the conduction path in the layer of the formed image can be further lowered, so that it is possible to more reliably suppress the electrostatic adhesion between the sheets after image formation.

In the present invention, it is preferable that the image surface resistance value is set to be $3\times10^{13}$ Ω or less. This makes it possible to more reliably suppress the electrostatic adhesion between the sheets after image formation.

In the present invention, it is preferable that the toner mother particles have a volume-based median diameter in the range of 4 to 7 μm. When it is 4 μm or more, the disappearance of the conduction path due to excessive increase in the interfacial area between the toner mother particles in the layer of the formed image is suppressed. When the thickness is 7 μm or less, the interface part between the toner mother particles among the layers of the formed image is moderately increased, and more conductive paths can be formed. This makes it possible to more reliably suppress the electrostatic adhesion between the sheets after image formation.

In the present invention, it is preferable that the electrostatic image developing toner contains a crystalline substance. As a result, the crystalline substance tends to remain in the layer of the image to be formed, and conduction paths are likely to be formed. This makes it possible to more reliably suppress the electrostatic adhesion between the sheets after image formation.

In the present invention, it is preferable that the crystalline substance contained in the electrostatic image developing toner is a crystalline polyester resin. Since the crystalline polyester resin has a small emulsion diameter in the aqueous medium at the time of manufacturing the electrostatic image developing toner, it can be made easier to form a conduction path in the layer of the image formed using the toner for developing the electrostatic image. This makes it possible to more reliably suppress the electrostatic adhesion between the sheets after image formation.

In the present invention, it is preferable that the colorant tends to have more polar groups than the resin constituting the toner for developing electrostatic images, and furthermore, since it contains a metal element, it is easy to form a conduction path in the layer of the image to be formed. This makes it possible to more reliably suppress the electrostatic adhesion between the sheets after image formation.

In the present invention, it is preferable that the electrostatic image developing toner exhibits a Net intensity of Group 2 element of 2.00 or more in the fluorescent X-ray analysis. As the content of the Group 2 element (for example, magnesium) in the electrostatic image developing toner is increased, the electric charge is more likely to move via the metal ions, so that charge is hardly accumulated in the image. Consequently, it is possible to more reliably suppress electrostatic adhesion between sheets after image formation.

In the present invention, it is preferable that the electrostatic image developing toner exhibits a Net intensity of Group 1 element of 0.20 or more in the fluorescent X-ray analysis. As the content of the Group 1 element (for example, sodium) in the toner for developing an electrostatic image is larger, the charge is more likely to move via the metal ion, so that the charge is hardly accumulated in the image. Consequently, it is possible to more reliably suppress electrostatic adhesion between sheets after image formation.

Hereinafter, the present invention, its constituent elements, and configurations and embodiments for carrying out the present invention will be described in detail. In the present description, when two figures are used to indicate a range of value before and after "to", these figures are included in the range as a lower limit value and an upper limit value.

«Outline of Image Forming Method»

An image forming method of the present invention is a method of using an electrostatic image developing toner containing: toner mother particles including a binder resin; and an external additive. It is characterized in that the binder resin contains a vinyl resin in an amount of 40 mass % or more with respect to the total amount of the binder resin, and the image forming method forms an image so that an image surface resistance value at 70° C. by a temperature change method of the formed image is set to be $5\times10^{13}$ Ω or less.

Further, the toner in the present invention means an aggregate of toner particles. Further, the toner particles are those obtained by adding an external additive to toner mother particles. In the present invention, when it is unnecessary to distinguish toner mother particles from toner particles, they may be simply referred to as toner particles in some cases.

(Image Surface Resistance Value at 70° C. by a Temperature Change Method)

In the image forming method of the present invention, image formation is carried out so that the image surface resistance value at 70° C. by a temperature change method is set to be $5\times10^{13}$ Ω or less. By this, during double-sided printing, when the toner image transferred to the second side of the sheet is fixed, the surface image is brought into contact with the pressure roller, whereby the charge accumulated in the surface image flows easily, and electrostatic adhesion between the sheets after image formation is suppressed. In addition, the image surface resistance value at 70° C. according to the temperature change method is preferably $3\times10^{13}$ Ω or less, and electrostatic adhesion can be suppressed more reliably.

It is possible to lower the image surface resistance value at 70° C. according to the temperature change method by increasing the content of the external additive in the toner to be used, for example. Besides, for example, it is possible to lower the image surface resistance value by decreasing the particle diameter of the toner mother particles or decreasing the electric resistance value of the toner mother particles themselves. As a method for lowering the electric resistance value of the toner mother particles themselves, there may be mentioned, for example, a method of increasing the content of metal ions in toner mother particles.

In the present invention, the image surface resistance value at 70° C. according to the temperature change method may be obtained as follows. That is, first, a copying machine "bizhub PRESS™ C 1070" (manufactured by Konica Minolta, Inc.) is modified, and two developing units filled with a developer are set at the magenta position and the cyan position, respectively. At that time, developing units are not set at the yellow position and the black position. On one surface of OK topcoated paper of A3 (manufactured by Oji Paper Co., Ltd., basis weight: 157 g/m$^2$, surface resistance value: $5.2\times10^{11}$ Ω) under normal temperature and normal humidity (temperature 20° C., humidity 50 % RH) is formed a solid image with a toner adhesion amount of 8 g/m$^2$. The solid image is fixed while the temperature of the pressure roller of a fixing unit is set at 70° C. to form an image. Next, the OK topcoated paper of A3 on which the image was formed is cut into 20 cm square. Using this as a measurement sample, measurements are carried out with a high resistance measuring apparatus 5451 (manufactured by ADC Co., Ltd.) with an electrode placed inside a compact thermostatic chamber (SH-222 made by ESPEC Co. Ltd.) in an environment of 25° C. and 50 % RH. Measurement conditions are: main electrode diameter 50 mm, applied voltage 1000 V, discharge time 3 minutes, charge time 1 second, measurement interval every 10 seconds. The temperature program of the compact thermostatic chamber is made as: keeping the temperature at 25° C. for 3 minutes, then, increasing the temperature to 100° C. at a heating rate of 6° C./min. Simultaneously with the start of the temperature program, the measurement of the high resistance measuring apparatus was started, the behavior of the surface resistance value of the sample with respect to the temperature from 25° C. to 100° C. was obtained, and the surface resistance value at 70° C. was measured as an image surface resistance value according to the present invention. The temperature change method is a method of performing measurement while changing the temperature as described above. Further, as the paper used in the above measuring method, similar measurement results can be obtained even with other types of paper as long as it has the same basis weight and surface resistance value as the above-mentioned paper.

In the present invention, the surface resistance value of the paper may be measured its the following manner.

Namely, paper to be measured was cut into a 20 cm square, measurement is carried out by using a high resistance measurement apparatus 5451 (manufactured by ADC Co., Ltd.) with an electrode placed inside a compact thermostatic chamber (SH-222 manufactured by ESPEC Co. Ltd.) in an environment of 25° C. and 50 % RH. Measurement conditions are: main electrode diameter 50 mm, applied voltage 1000 V, discharge time 3 minutes, charge time 1 second, measurement interval every 10 seconds. The compact thermostatic chamber is set at a fixed value of 25° C. and measurement is performed for 5 minutes. The value obtained by averaging the measured values for 3 to 5 minutes is taken as the surface resistance value of the paper.

«Image Forming Apparatus»

The image forming method of the present invention may be carried out by using a conventionally known electrophotographic image forming apparatus. An image forming apparatus that may be used for the image forming method of the present invention will be described below.

The image forming apparatus is provided with: a photoreceptor, a device for forming an electrostatic latent image on the photoreceptor, a device for developing the electrostatic latent image with a toner to form a toner image, and a device to transfer formed toner image onto a sheet, and a device for fixing the transferred toner image on the paper.

FIG. 1 is a schematic configuration diagram illustrating an example of the configuration of an image forming apparatus used in the image forming method of the present invention.

An image forming apparatus 100 illustrated in FIG. 1 has a main body A of the image forming apparatus including: four image forming units 10Y, 10M, 10C, and 10Bk; an intermediate transferring unit 7 that transfer the toner image of each color produced in the image forming units 10Y, 10M, 10C, and 10Bk to a recording medium P; and a fixing unit 24 that fixes the toner image on the recording medium P. The image forming apparatus further includes a document scanner SC above the main body A of the image forming apparatus to scan the document optically and read image information as digital data (document image data).

The image forming units 10M, 10C, and 10Bk each respectively form a toner image with a magenta toner, a cyan toner and a black toner in place of a yellow toner. Basically, they have same configuration as the image forming unit 10Y. Therefore, hereinafter, the image forming unit 10Y will be described as an example, and the description of the image forming units 10M, 10C, and 10Bk will be omitted.

The image forming unit 10Y includes a drum shape photoreceptor 1Y for forming an image, surrounded therearound by: a charging unit 2Y that gives a uniform electric potential to the surface of the photoreceptor 1Y, an exposing unit 3Y that performs exposure based on the image data signal for exposure (yellow) to form an electrostatic latent image corresponding to an image of yellow, a developing unit 4Y for conveying the toner onto the photoreceptor 1Y to visualize the electrostatic latent image, and a cleaning unit 6Y for collecting the residual toner remaining on the photoreceptor 1Y after the primary transfer. The image forming unit 10Y forms a yellow (Y) image. Here, in the developing unit 4Y, a toner whose external additive content is adjusted is loaded so that the image surface resistance value at 70° C. is $5\times10^{13}$ Ω or less according to the temperature change method of the formed image.

As the charging unit 2Y, a corona discharge type charger is used.

As the exposure unit 3Y, a light emitting diode is used as an exposure light source. Examples thereof are: a light irradiation device including an LED unit its which light emitting elements including light emitting diodes are arrayed in the axial direction of the photoreceptor 1Y and an imaging element; and a laser irradiation device of a laser optical system using a semiconductor laser as an exposure light source. In the image forming apparatus 100 illustrated in FIG. 1, a laser irradiation device is provided.

In the exposure unit 3Y, it is preferable to use a device using a semiconductor laser or a light emitting diode having an oscillation wavelength of 350 to 850 nm as an exposure light source. Using such an exposure light source with the exposure dot diameter in the main direction of writing set to 10 to 100 μm and performing digital exposure on the photoreceptor 1Y, it is possible to obtain an electrophotographic image of high resolution from 600 dpi to 2400 dpi or higher.

As the exposure method in the exposure unit 3Y, a scanning optical system using a semiconductor laser may be used, or a solid type using an LED may be used.

The intermediate transferring unit 7 contains: a rotatable endless belt type intermediate transfer member 70 that is wound around rollers 71, 72, 73, and 74; first transfer rollers 5Y, 5M, 5C, and 5Bk for transferring the toner images formed by the image forming units 10M, 10C, and 10Bk; a secondary transfer roller 5*b* that transfers the toner image transferred onto the intermediate transfer member 70 by the primary transfer rollers 5Y, 5M, 5C, and 5Bk onto the recording medium P; and a cleaning unit 6*b* for collecting the residual toner remaining on the intermediate transfer member 70.

During image formation, the first transfer roller 5Bk in the intermediate transferring unit 7 continuously abuts the surface of the electrophotographic photoreceptor 1Bk. On the other hand, the first transfer rollers 5Y, 5M, and 5C abut the surface of the corresponding photoreceptors 1Y, 1M, and 1C only when a color image is formed.

Further, the second transfer roller 5*b* abuts the surface of the intermediate transferring member 70 only when the recording medium P passes and the second transfer is performed.

For example, the fixing unit 24 includes: a heating roller 241 having a heating source therein; and a pressure roller 242 provided in a state pressed to form a fixing nip portion on the heating roller 241.

In the image forming apparatus 100 as described above, the surfaces of the photoreceptors 1Y, 1M, 1C, and 1Bk are charged by the charging units 2Y, 2M, 2C, and 2Bk. Then, the exposure units 3Y, 3M, 3C, 3Bk are operated in accordance with the exposure image data signals of the respective colors obtained by subjecting the original image data acquired by the original image reading device SC to various image processing. Specifically, laser light modulated corresponding to the exposure image data signal is output from the exposure light source, and the photoreceptors 1Y, 1M, 1C, and 1Bk are scanned and exposed by the laser light. By this, electrostatic latent images corresponding to the respective colors of yellow, magenta, cyan, and black corresponding to the original read by the original image reading device SC are formed on the photoreceptors 1Y, 1M, 1C, and 1Bk, respectively.

Then, the electrostatic latent images formed on the photoreceptors 1Y, 1M, 1C, and 1Bk are developed with toner of each color by the developing units 4Y, 4M, 4C, and 4Bk, whereby toner images of respective colors are formed. The toner images of the respective colors are sequentially transferred onto the intermediate transfer member 70 by the primary transfer rollers 5Y, 5M, 5C, and 5Bk, superimposed and combined, and a color toner image is formed.

Further, in synchronization with the formation of the color toner image, the recording medium P accommodated in the paper feed cassette 20 is fed by the paper feed unit 21, and through the plurality of intermediate rollers 22A, 22B, 22C, 22D and the registration rollers 23, the recording medium P is conveyed to the secondary transfer roller 5*b*. The color toner images transferred onto the intermediate transfer member 70 by the secondary transfer roller 5*b* are collectively transferred onto the recording medium P.

The color toner image transferred onto the recording medium P is heated and pressed by the fixing unit 24, whereby the color toner image is fixed and a visible image (toner layer) is formed. Thereafter, the recording medium P oil which the visible image is formed is discharged to the outside of the apparatus from the discharge port 26 by the discharge roller 25, and is placed on the discharge tray 27.

When double-side printing is performed, the recording medium P on which an image has been formed on the first side, which is conveyed from the fixing unit 24, is conveyed from the switching gate 31 into the reverse conveyance path 32, the front and back of the recording medium P are reversed. Then, it is fed again to the vicinity of the intermediate roller 22D, and image formation is performed on the second side of the recording medium P. At this time, the surface image formed on the first surface of the recording medium P has an image surface resistance value at 70° C. of $5\times10^{13}$ Ω or less by the temperature change method, the charge accumulated when the front side image comes into contact with the pressure roller 242 of the fixing unit 24 is released and electrostatic adhesion between the papers is effectively suppressed.

The photoreceptors 1Y, 1M, 1C, and 1Bk after transferring the toner images of the respective colors onto the intermediate transfer member 70, are used for forming the following color toner images, after the toner remaining on the photoreceptors 1Y, 1M, 1C, and 1Bk are removed by the cleaning units 6Y, 6M, 6C, and 6Bk.

On the other hand, after the color toner image is transferred onto the recording medium P by the secondary transfer roller 5*b* and the recording medium P has undergone curvature separation, the toner remaining on the intermediate transfer member 70 is removed by the cleaning device 6*b*. Then, the intermediate transfer member 70 is used for intermediate transfer of the next toner image.

«Electrostatic Image Developing Toner»

The electrostatic image developing toner used in the image forming method of the present invention comprises toner mother particles containing a binder resin and an external additive, wherein the binder resin contains a vinyl resin in an amount of 40 mass % or more with respect to the total mass of the binder resin.

As described above, the electrostatic image developing toner used in the image forming method of the present invention is preferably prepared so that the image surface resistance value at 70° C. by the temperature change method of the formed image is set to be $5\times10^{13}$ Ω or less by adjusting the content of external additive, for example.

The electrostatic image developing toner according to the present invention is not particularly limited as long as it satisfies the above conditions. It may contain for example, a colorant, a releasing agent, and a charge controlling agent when required.

(Net Intensity of Group 1 Element or Group 2 Element in X-Ray Fluorescence Analysis)

It is preferable that the electrostatic image developing toner according to the present invention has a Net intensity of Group 2 element in X-ray fluorescence analysis of 2.00 or more. The Net intensity of the Group 2 element is adjusted, for example, at the time of manufacturing the toner by adjusting the amount of sodium chloride to be added when grain growth of the associated particles formed by aggregating the binder resin particles is stopped. By doing so, the Net intensity is controllable. It is to be noted that the Net intensity is a value of the total amount when a plurality of types of Group 2 elements are detected in the X-ray fluorescence analysis.

It is preferable that the electrostatic image developing toner according to the present invention has a Net intensity of Group 1 element in X-ray fluorescence analysis of 0.20 or more. The Net strength of the Group 1 element is adjusted, for example, at the time of manufacturing the toner by adjusting the amount of sodium chloride to be added when grain growth of the associated particles formed by aggregating the binder resin particles is stopped. By doing so, the Net intensity is controllable. It is to be noted that the Net intensity is a value of the total amount when a plurality of types of Group 1 elements are detected in the X-ray fluorescence analysis.

The Net intensity of Group 1 element or Group 2 element in fluorescent X-ray analysis may be measured as follows. The Net intensity of the metal contained in the toner sample is measured with an X-ray fluorescence analyzer "XRF-1700" (produced by SHIMADZU Corporation). In a specific measurement process, 2 g of toner sample is pelletized under pressure of 15 t for 10 seconds. The pellets are subjected to qualitative analysis under the following conditions. In the analysis, the Kα peak angle of the target element is determined from a 2θ table.

(Conditions of Measurement)

Slit: standard

Attenuator: none

Dispersive crystal: (Na, Mg=TAP, Ca, K=LiF)

Detector: (NA, Mg, Ca, K=FPC)

(Glass Transition Point of Toner)

The glass transition point (Tg) of the toner according to the present invention is preferably in the range of 25 to 65° C., more preferably, in the range of 35 to 55° C., for example. When the glass transition point of the toner according to the present invention is within the above range, sufficient low-temperature fixability and heat-resistant storage property may be obtained at the same time.

The glass transition point of the toner is determined with a differential scanning calorimeter "Diamond DSC" (made by PerkinElmer Inc.) as follows.

A sample (3.0 mg) is sealed in an aluminum pan, and it is placed on a sample holder. An empty aluminum pan is placed on a reference holder. As the measurement conditions, temperature control of Heat-cool-Heat is carried out at a measuring temperature of 0 to 200° C. at a heating rate of 10° C./min and a cooling rate of 10° C./min. Analysis is performed based on data in the second Heat. An extension line of the base line before the rise of the first endothermic peak, and a tangent line showing the maximum inclination is drawn from the rising portion of the first peak to the peak point, and the intersection is taken as the glass transition point.

<Average Particle Size of Toner Particles>

It is preferable that the toner mother particles of the present invention have an average particle size of 3 to 8 μm, more preferably 4 to 7 μm in volume-based median diameter ($D_{50}$). This average particle size may be controlled by the concentration of the aggregation agent used at the time of production, the amount of addition of the organic solvent, the fusion time, and the composition of the binder resin (binder resin). When the volume-based median diameter falls within the above-mentioned range, it is possible to faithfully reproduce a very fine dot image at a level of 1,200 dpi.

In the present invention, the volume-based median diameter ($D_{50}$) of the toner particles is measured and calculated by using measuring equipment composed of a "COULTER COUNTER 3" (Beckman Coulter Inc.) and a computer system installed with data processing software "Software V3.51" (Beckman Coulter Inc.) connected thereto.

In the specific measuring process, 0.02 g of sample to be measured (the toner particles) is blended in 20 mL of the surfactant solution (for the purpose of dispersing toner particles, for example, a surfactant solution in which a neutral detergent including a surfactant component is diluted by 10 times with pure water), ultrasonic dispersion is performed for 1 minute and a toner particle dispersion liquid is made. This toner particle dispersion liquid is poured into a beaker including ISOTON II (manufactured by Beckman Coulter, Inc.) in the sample stand with a pipette until the measurement concentration is 8 mass %.

By setting this content range, it is possible to obtain a reproducible measurement value. Then, the liquid is measured by setting the counter of the particle to be measured to 25,000. The aperture diameter is set to be 100 μm. The frequency count is calculated by dividing the range of the measurement range 2 to 60 μm by 256. The particle size where the accumulated volume counted from the largest size reaches 50% is determined as the volume-based median diameter ($D_{50}$).

It is preferable that the toner particles constituting the toner according to the present invention have an average circularity in the range of 0.930 to 1.000, more preferably in the range of 0.950 to 0.995 from the viewpoints of stability of charging characteristics and low temperature fixability. When the average circularity is within the above range, individual toner particles are less likely to be crushed, contamination of the friction charging member is suppressed, the charging property of the toner is stabilized, and the image quality is high in the formed image.

The average circularity of toner particles is a value measured with a flow-type particle image analyzer "FPIA-3000" (made by Sysmex Corporation). Specifically, it may be measured by the following method.

A measuring sample (toner particles) is wetted in an aqueous surfactant solution, and it is ultrasonically dispersed for one minute. After making the dispersion, this dispersion is photographed at an appropriate concentration of 3000 to 10000 HPF detection numbers with measurement condition HPF (high magnification imaging) mode of "FPIA-3000" (manufactured by Sysmex Corporation). In the photographed image, circularity is calculated for each toner particle according to the following formula, the circularity of each toner particle is added, and by dividing by the total number of toner particles, an average circularity is calculated. Reproducibility is obtained if the HPF detection number is in the above range.

Circularity of toner particle=(Perimeter of a circle having a projected area identical to that of the projected image of a particle)/(Perimeter of the projected image of the particle)

[Toner Mother Particles]

The toner mother particles used in the present invention contain at least a crystalline resin. The toner mother particles may contain components constituting general toners such as crystalline substances, releasing agents, magnetic powders, and charge controlling agents, for example. In addition, the toner mother particles according to the present invention are preferably prepared by a wet production method (for example, an emulsion aggregation method) performed in an aqueous medium.

[1] Binder Resin

As the binder resin, it is preferable that the binder resin contains a vinyl resin in an amount of 40 mass % or more based on the entire binder resin, and further contains a crystalline polyester resin. The mass ratio (vinyl resin/crystalline polyester resin) of the vinyl resin and the crystalline polyester resin contained in the toner mother particles according to the present invention is preferably in the range of 99/1 to 80/20, more preferably in the range of 95/5 to 85/15. The binder resin may contain a material other than the vinyl resin and the crystalline polyester resin, and may contain, for example, an amorphous polyester resin.

Here, the crystalline resin means a resin having a melting point, that is, a definite endothermic peak at the time of temperature rise in an endothermic curve obtained by differential scanning calorimetry (DSC (Differential scanning calorimetry)). The definite endothermic peak means a peak having a half bandwidth of 15° C. in an endothermic curve when the temperature is raised at a heating rate of 10° C./min.

On the other hand, an amorphous resin refers to a resin which gives a baseline curve indicating that glass transition occurred is observed, but the definite endothermic peak described above is not observed in the endothermic curve obtained by conducting the same differential scanning calorimetry as above.

[1-1] Vinyl Resin

The vinyl resin is not particularly limited and conventionally known vinyl resins in the technical field may be used. Among them, it is preferable to contain amorphous vinyl resin. By containing a vinyl resin, a toner excellent in plasticity at the time of thermal fixation may be provided. In the present invention, the vinyl resin is a resin obtained by polymerization using at least a vinyl monomer.

Specific examples of the amorphous vinyl resin include an acrylic resin and a styrene-acrylic resin. Among them, as the amorphous vinyl resin, a styrene-acrylic resin formed using a styrene monomer and a (meth)acrylate ester monomer is preferable. Generally, in the case of styrene-acrylic resin, the charging property is not high and generation of electrostatic offset may be suppressed more favorably. When a styrene-acrylic resin is used, the content of styrene-acrylic resin is preferably in the range of 55 to 85 mass %, more preferably in the range of 60 to 80 mass % of the whole toner. By adjusting within this range, the volume resistivity of the toner may be controlled.

Examples of the vinyl monomer that forms the vinyl resin include: styrene monomers, (meth)acrylic acid ester monomers, vinyl esters, vinyl ethers, vinyl ketones, and N-vinyl compounds. The vinyl monomers may be used alone or in combination of two or more kinds.

(1) Styrene Monomers

Examples of the styrene monomer are: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers.

(2) (Meth)Acrylic Acid Ester Monomers

Examples of the (meth)acrylic acid ester monomer are: methyl (meth)acrylate, ethyl (meth)acrylate, n-butyl (meth) acrylate, iso-propyl (meth)acrylate, iso-butyl (meth)acrylate, t-butyl (meth)acrylate, n-octyl (meth)acrylate, 2-ethylhexyl (meth)acrylate, stearyl (meth)acrylate, lauryl (meth) acrylate, phenyl (meth)acrylate, diethylaminoethyl (meth) acrylate and dimethylaminoethyl (meth)acrylate, and derivatives of these monomers.

(3) Vinyl Esters

Examples of the vinyl ester are: vinyl propionate, vinyl acetate, and vinyl benzoate.

(4) Vinyl Ethers

Vinyl methyl ether and vinyl ethyl ether.

(5) Vinyl Ketones

Examples of the vinyl methyl ketone are: vinyl ethyl ketone and vinyl hexyl ketone.

(6) N-Vinyl Compounds

Examples of the N-vinyl carbazole are: N-vinyl indole, and N-vinyl pyrrolidone.

(7) Others

Vinyl compounds such as vinylnaphthalene and vinylpyridine; acrylic acid or methacrylic acid derivatives such as acrylonitrile, methacrylonitrile, and acrylamide are also used.

It is preferable to use a vinyl monomer containing an ionic dissociation group such as a carboxy group, a sulfonic acid group or a phosphoric acid group.

Examples of the monomer containing a carboxy group are: acrylic acid, methacrylic acid, maleic acid, itaconic acid, cinnamic acid, fumaric acid, monoalkyl maleate, and monoalkyl itaconate. Examples of the monomer containing a sulfonic acid group are: styrenesulfonic acid, allylsulfosuccinic acid, and 2-acrylamido-2-methylpropanesulfonic acid. An example of a monomer containing a phosphoric acid group is acid phosphooxyethylmethacrylate.

Further, the amorphous vinyl polymer may be changed into a cross-linked resin by using a poly-functional vinyl compound as a vinyl monomer. Examples of the poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

As described above, the vinyl resins are described in detail as a preferred embodiment of an amorphous resin. The present invention is not limited to the vinyl resins. An amorphous polyester resin may be also used.

The glass transition point (Tg) of the vinyl resin is preferably in the range of 40 to 70° C., more preferably in the range of 45 to 65° C., for example. When the glass transition temperature of the vinyl resin is within this range, sufficient low-temperature fixability and heat-resistant storage stability are obtained at the same time. The glass transition point (Tg) of the vinyl resin may be measured its the same manner as the glass transition point (Tg) of the toner.

Further, the molecular weight of the vinyl resin measured by gel permeation chromatography (GPC) is preferably within the range of, for example, 10,000 to 100,000 in terms of weight average molecular weight (Mw).

In the present invention, the molecular weight of the vinyl resin measured by GPC is a value measured as follows. The weight average molecular weight was determined with a gel permeation chromatograph "HLC-8220" (made by Tosoh Corporation) provided with three columns of "TSKguard column+TSKgel SuperHZM-M" (made by Tosoh Corporation). While the column temperature was kept at 40° C., a carrier solvent tetrahydrofuran (THF) was fed through the columns at a flow rate of 0.2 mL/min. The measurement sample (vinyl resin) was dissolved in tetrahydrofuran so as to have a concentration of 1 mg/mL under dissolution conditions in which treatment was carried out for 5 minutes at room temperature using an ultrasonic disperser, and treated with a membrane filter having a pore size of 0.2 μm to obtain a sample solution. This sample solution (10 μL) was injected into the apparatus to measure the refractive index with a refractive index detector (RI detector). The molecular weight distribution of the sample was determined through calculation using a calibration curve determined with monodispersed standard polystyrene beads. Ten points were used as polystyrene for calibration curve measurement.

[1-2] Crystalline Polyester Resin

The crystalline polyester resin refers to a crystalline polyester resin among known polyester resins obtained by a polycondensation reaction between a divalent or higher valent carboxylic acid (polyvalent carboxylic acid) and a dihydric or higher alcohol (polyhydric alcohol).

The polyvalent carboxylic acid is a compound having two or more carboxy groups in one molecule. Specific examples thereof include: saturated aliphatic dicarboxylic acids such as oxalic acid, malonic acid, succinic acid, adipic acid, sebacic acid, azelaic acid, n-dodecylsuccinic acid, nonanedicarboxylic acid, decanedicarboxylic acid, undecane dicarboxylic acid, dodecanedicarboxylic acid, and tetradecanedicarboxylic acid; an alicyclic dicarboxylic acids such as cyclohexene dicarboxylic acid; aromatic dicarboxylic acids such as phthalic acid, isophthalic acid, and terephthalic acid; polycarboxylic acids having 3 or more valences such as trimellitic acid, and pyromellitic acid; and anhydrides of these carboxylic acid compounds or alkyl esters having 1 to 3 carbon atoms. These may be used alone, or may be used in combination of two or more kinds.

The polyhydric alcohol is a compound having two or more hydroxy groups in one molecule. Specific examples thereof include: aliphatic diols such as 1,2-propanediol, 1,3-propanediol, 1,4-butanediol, 1,5-pentanediol, 1,6-hexanediol, 1,7-heptanediol, 1,8-octanediol, 1,9-nonanediol, dodecanediol, neopentyl glycol, and 1,4-butenediol; and trivalent or more polyhydric alcohols such as glycerin, pentaerythritol, trimethylolpropane, and sorbitol. These may be used alone, or may be used in combination of two or more kinds.

The melting point (Tm) of the crystalline polyester resin is preferably in the range of 55 to 90° C., more preferably in the range of 70 to 85° C., for example. When the melting point of the crystalline polyester resin falls within the above range, sufficient low temperature fixability and excellent hot offset resistance may be obtained. The melting point of the crystalline polyester resin can be controlled by the resin composition.

In the present invention, the melting point of the crystalline polyester resin is a value measured as follows.

The melting point of the crystalline resin was determined with a differential scanning calorimeter "Diamond DSC" (made by PerkinElmer Inc.) as follows.

A first heating process of raising the temperature from 0° C. to 200° C. at a heating rate of 10° C./min, a cooling process of decreasing the temperature from 200° C. to 0° C. at a cooling rate of 10° C./min, and a second heating process of raising the temperature from 0° C. to 200° C. at a heating rate of 10° C./min are carried out in this order. Based on the DSC curve obtained by this processes, the endothermic peak top temperature derived from the crystalline polyester resin in the first heating process is taken as the melting point (Tm). As a measurement procedure, 0.3 mg of a measurement sample (crystalline polyester resin) is sealed in an aluminum pan and set in a sample holder of "Diamond DSC". An empty aluminum pan is used as a reference.

Further, it is preferable that the molecular weight of the crystalline polyester resin measured by gel permeation chromatography (GPC) is in the range of 5,000 to 50,000 in the weight average molecular weight (Mw), and in the range of 1500 to 25,000 in the number average molecular weight (Mn). The molecular weight of the crystalline polyester resin may be measured in the same manner as the molecular weight of the vinyl resin.

[1-3] Hybrid Crystalline Polyester Resin

It is preferable that the crystalline polyester resin contains a crystalline polyester resin formed by chemically bonding a vinyl-based polymerization segment and a polyester polymerization segment (hereinafter, the crystalline polyester resin having such a plurality of segments is also referred to as a hybrid crystalline polyester resin, or simply as a hybrid resin.) In this case, it is preferable that the vinyl-based polymerized segment and the polyester polymerization segment are bound via bi-reactive monomers. In addition, the above polyester polymerization segment refers to a portion derived from a crystalline polyester resin. That is, it refers to a molecular chain having the same chemical structure as that constituting the crystalline polyester resin.

The vinyl-based polymerization segment constituting the hybrid resin means a moiety derived from a vinyl resin. That is, it refers to a molecular chain having the same chemical structure as that constituting the vinyl resin. Here, as the vinyl monomer, the above-mentioned one as the monomer constituting the vinyl resin may be similarly used, so a detailed description thereof will be omitted here. The content of the vinyl polymerization segment in the hybrid resin is not particularly limited, but the hybridization ratio of the hybrid resin is preferably 40 mass % or more, more preferably 40 to 60 mass %, and still more preferably in the range of 45 to 50 mass %.

The polyester polymerization segment constituting the hybrid resin is composed of a crystalline polyester resin produced by subjecting a polycarboxylic acid and a polyhydric alcohol to a polycondensation reaction in the presence of a catalyst. Here, specific types of polyvalent carboxylic acid and polyhydric alcohol are as described above.

A bi-reactive monomer is a monomer that binds a polyester polymerization segment and a vinyl-based polymerization segments. It is a monomer containing in the molecule both a group selected from a hydroxy group, a carboxy group, an epoxy group, a primary amino group and a secondary amino group to form a polyester polymerization segment and an ethylenically unsaturated group to form a vinyl-based polymerization segment. The bi-reactive monomer is preferably a monomer having a hydroxy group or a carboxy group and an ethylenically unsaturated group. More preferably, it is a monomer having a carboxy group and an ethylenically unsaturated group. That is, vinyl carboxylic acid is preferable. Specific examples of the bi-reactive monomer include: acrylic acid, methacrylic acid, fumaric acid, and maleic acid. Specific examples thereof may also be esters of a hydroxyalkyl group having 1 to 3 carbon atoms. From the viewpoint of reactivity, acrylic acid, methacrylic acid or fumaric acid is preferable. The polyester polymerization segment and the vinyl-based polymerization segment are bonded via the bi-reactive monomer. From the viewpoint of improving the low temperature fixability, high temperature offset resistance and durability of the toner, the amount of bi-reactive monomer to be used is preferably, for example, 1 to 10 mass parts, more preferably, 4 to 8 mass part with respect to the total amount (100 mass parts) of vinyl monomer constituting the vinyl-based polymerization segment.

(Preparation of Hybrid Resin)

The hybrid resin may be prepared by a process according to a known standard scheme. Typical examples of the process are the following three processes:

(1) A process of preliminarily polymerizing a polyester polymerization segment, reacting the polyester polymerization segment with a bi-reactive monomer, and further reacting monomers for forming a vinyl polymerization segment (such as, an aromatic vinyl monomer and a (meth)acrylate monomer) to form a hybrid resin.

(2) A process of preliminarily polymerizing a vinyl polymerization segment, reacting the vinyl polymerization segment with a bi-reactive monomer, and further reacting the resultant with a polyvalent carboxylic acid and a polyhydric alcohol to form a polyester polymerization segment.

(3) A process of preliminarily polymerizing a polyester polymerization segment and a vinyl polymerization segment, separately, and reacting these segments with a bi-reactive monomer to bond the segments to each other.

Any one of the processes may be used in the present invention. Preferred is Process (2). Specifically, the following process is preferred: a polyvalent carboxylic acid and a polyhydric alcohol for forming a polyester polymerization segment, monomers for forming a vinyl polymerization segment, and a bi-reactive monomer are mixed. A polymerization initiator is added to form a vinyl polymerization segment through addition polymerization of the monomers for forming the vinyl polymerization segment and the bi-reactive monomer. An esterification catalyst is then added to perform a polycondensation reaction.

In this process, the catalyst for synthesizing the polyester polymerization segment may be selected from a variety of known catalysts. Examples of the esterification catalyst include tin compounds, such as dibutyltin oxide and tin(II) 2-ethylhexanoate; and titanium compounds, such as titanium diisopropylate bis(triethanolaminate). Examples of the esterification catalyst include gallic acid (3,4,5-trihydroxybenzoic acid).

[2] Crystalline Substance

The toner mother particles according to the present invention preferably contain a crystalline substance. This makes it easier for the crystalline substance to remain in the layer of the image to be formed and makes it easier to form a conduction path. Therefore, it is possible to more reliably suppress electrostatic adhesion between sheets after image formation.

The crystalline substance according to the present invention refers to a substance having a definite endothermic peak at the melting point, i.e., temperature rise, in an endothermic curve obtained by differential scanning calorimetry (DSC: Differential scanning calorimetry). The distinct endothermic peak indicates an endothermic peak having a half width within 15° C. or less at a heating rate of 10° C./min in the DSC.

Specific examples of such a crystalline substance include the aforementioned crystalline polyester resin and a releasing agent such as wax. Among them, it is preferable to contain a crystalline polyester resin as a crystalline substance. Specifically, it is preferable that the crystalline polyester resin is contained in the toner mother particle in the range of 1 to 20 mass % in order to further suppress occurrence of electrostatic offset and to improve the charging property of the toner. When it is 1 mass % or more, generation of electrostatic offset will be further suppressed. Further, when the content is 20 mass % or less, the toner charging property will be improved.

[Releasing Agent]

It is preferable that the toner mother particles according to the present invention contain a releasing agent from the viewpoint of more appropriately exhibiting the effect. When the toner mother particles are configured to contain a releasing agent, it is preferable that the releasing agent is contained in the vinyl resin, particularly from the viewpoint of bleeding out of the releasing agent on the surface of the image at the time of fixing.

As a releasing agent, a known releasing agent may be used, and examples thereof include waxes. As a wax, a low molecular weight polypropylene, a polyethylene or an oxidized polypropylene, a polyolefin type wax such as polyethylene, an ester type wax such as behenyl behenate may be suitably used. Among them, it is preferable to contain an ester wax as a releasing agent. This is because the ester wax has high crystallinity and can more suitably suppress electrostatic adhesion between sheets. The releasing agent may be added in the aggregating step of the binder resin as a dispersion liquid, but from the viewpoint of releasing agent dispersibility inside the toner mother particles, it is preferably added in the step of polymerizing the vinyl resin.

Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide.

Among these, from the viewpoint of releasing property at low temperature fixing, those having a low melting point, specifically, those having a melting point in the range of 40 to 90° C. are preferably used.

The content ratio of the releasing agent in the toner mother particles is preferably in the range of 1 to 20 mass %, more preferably in the range of 5 to 20 mass %.

[Colorant]

As the colorant, commonly known dyes and pigments may be used.

As the colorant for obtaining a black toner, it may be arbitrarily used the following known materials: carbon blacks such as furnace black and channel black, magnetic materials such as magnetite and ferrite, dyes, inorganic pigments including non-magnetic iron oxide.

Known colorants such as dyes and organic pigments may be arbitrarily used as a colorant for obtaining color toner. Example of the organic pigment include: C. I. Pigment Reds 5, 48:1, 48:2, 48:3, 53:1, 57:1, 81:4, 122, 139, 144, 149, 166, 177, 178, 222, 238, and 269; C. I. Pigment Oranges 31 and 43; C. I. Pigment Yellows 14, 17, 74, 93, 94, 138, 155, 180, and 185; C. I. Pigment Oranges 31 and 43; and C. I. Pigment Blues 15:3, 15:4, and 60. Examples of the dye include: C. I. Solvent Reds 1, 49, 52, 58, 68, 11, and 122; C. I. Solvent Yellows 19, 44, 77, 79, 81, 82, 93, 98, 103, 104, 112, and 162; and C. I. Solvent Blues 25, 36, 69, 70, 93, and 95.

The colorant for obtaining each color toner may be used singly or in combination of two or more kinds. The content ratio of the colorant is preferably in the range of 1 to 20 mass parts, more preferably 4 to 15 mass parts with respect to 100 mass parts of the binder resin.

[5] Charge Controlling Agent

As a charge controlling agent, a variety of known compounds may be used. Specific examples thereof include: nigrosine dyes, metal salts of naphthenic acid or higher fatty acids, alkoxyamines, quaternary ammonium salts, azo metal complexes, and salicylic acid metal salts.

The content ratio of the charge controlling agent is usually in the range of 0.1 to 10 mass parts, preferably in the range of 0.5 to 5 mass parts with respect to 100 mass parts of the binder resin.

[External Additive]

The toner according to the present invention contains an external additive in addition to the toner mother particles. As the external additive, conventionally known external additives may be used.

Examples of the external additives include: inorganic oxide particles such as silica particles, aluminum oxide particles and titanium oxide particles; and inorganic titanic acid compound particles such as strontium titanate and zinc titanate. These may be used singly or in combination of two or more kinds. From the viewpoint of improving heat-resistant storage property and environmental stability, it is preferable that these inorganic particles are surface-treated with a silane coupling agent, a titanium coupling agent, a higher fatty acid, or a silicone oil.

Organic particles such as particles obtained by radical polymerization of a radically polymerizable monomer containing a crosslinkable vinyl monomer may be used as an external additive.

The addition amount of the external additive (or the total amount when two or more kinds are used) is preferably in the range of 0.05 to 5 mass %, for example, more preferably in the range of 0.1 to 3 mass % with respect to the mass of the entire toner including the external additive (100 mass parts).

The particle size of the external additive is not particularly limited, but it is preferable to use inorganic particles having a number average primary particle diameter of about 2 to 800 nm, or organic particles having a number average primary particle diameter of about 10 to 2000 nm, for example. In the present invention, the number average primary particle diameter of the external additive may be obtained by binarizing a scanning electron micrograph of the external additive particles, calculating the horizontal Feret diameter for 10,000 particles, and taking the average thereof.

In particular, in the present invention, it is preferable that an external additive having a number average primary particle diameter of 30 nm or less is contained its an amount of 4 mass parts or more based on 100 mass parts of the toner mother particles. Thereby, in the layer of the formed image, external additives are continuously present at the interface portion between the toner mother particles to result in more surely forming a conduction path through which charges will move. As a result, it is possible to more reliably suppress electrostatic adhesion between sheets after image formation.

In the present invention, among the external additives having a number average primary particle diameter of 30 nm or less, it is preferable that the content of the one having a volume resistivity of $1\times10^{10}$ Ω·cm or less is in the range of 30 to 100 mass % with respect to the whole external additive having a number average primary particle diameter of 30 nm or less. Thereby, the electric resistance value of the conduction path in the formed image layer will be further decreased. As a result, it is possible to more reliably suppress electrostatic adhesion between sheets after image formation.

Figure 2:
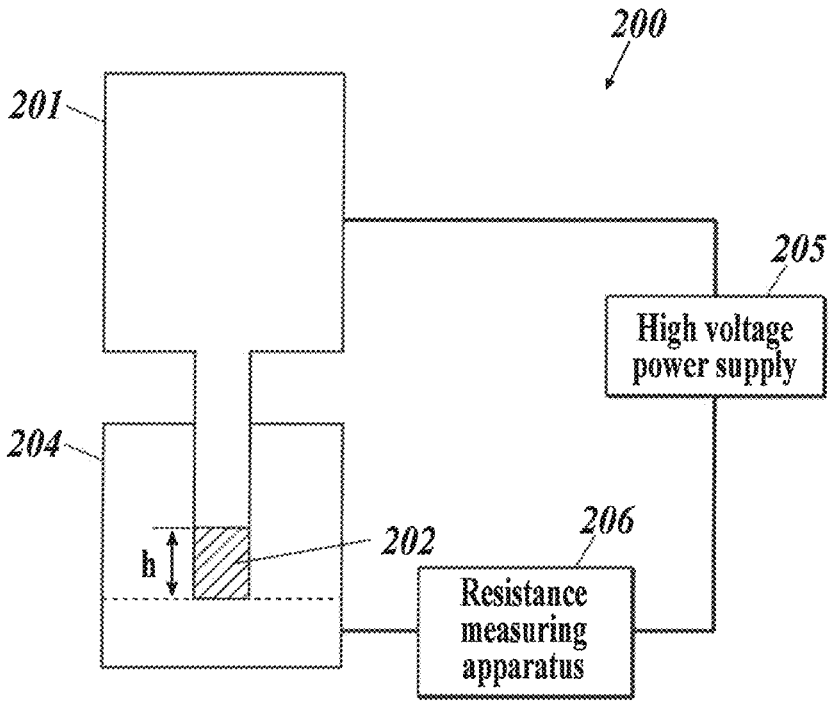
FIG. 2 is a schematic constitutional diagram illustrating an example of a measuring apparatus for measuring a volume resistivity of an external additive.

Here, in the present invention, the volume resistivity of the external additive may be measured using the measuring apparatus 200 illustrated in FIG. 2. FIG. 2 is a schematic configuration diagram of the measuring apparatus 200. The measuring apparatus 200 includes: a load unit 201, a main body cell 204, a high voltage power supply 205, and a resistance measuring device 206. It is a device capable of measuring the resistance value of the sample 202. As a sample 202, 1 g of the external additive s1 or the external additive s2 is set on a region of 0.968 $cm^2$ to have a height h. Using such a measuring apparatus 200, the resistance value of the sample 202 after 10 seconds from the start of measurement at a load of 1400 g under an environment of 20° C. and 50 RH % is measured. From the obtained resistance value, the volume resistivity is calculated according to the following formula.

$$\text{Volume resistivity } (\Omega\cdot\text{cm}) = \{\text{Resistance value } (\Omega)\times 0.968\ (\text{cm}^2)\}/\text{Sample height h (cm)}$$

«Production Method of Electrostatic Image Developing Toner>

The production method of the toner used in the present invention is not particularly limited. Examples of the method include: a kneading pulverization method, a suspension polymerization method, an emulsion aggregation method, a dissolution suspension method, a polyester extension method, and a dispersion polymerization method. Among these processes, preferred is emulsion aggregation method in view of the uniformity of the particle size, control of the shape of the toner, and ease of forming core-shell structure. The emulsion aggregation method is described in the following.

In the emulsion aggregation method, toner particles are prepared as follows. A dispersion liquid of particles of a binder resin dispersed in a surfactant containing a dispersion stabilizer (hereinafter, also referred to as "binder resin particles") is mixed with a dispersion liquid of releasing agent particles and colorant particles, and these particles are aggregated until the toner particles grow to a desired particle size. The binder resin particles are further fused to control the shapes of the toner particles. In this specification, the binder resin particles may optionally contain a colorant and a charge controlling agent.

The above production method may be constituted by, for example, the following steps. Here, the following example is an example of the case where the toner mother particles contain a colorant, the binder resin contains a crystalline polyester resin, and the vinyl resin particles contain a releasing agent. The technical scope of the present invention is not limited to this embodiment.

(1) A vinyl resin particle dispersion preparation step for preparing a vinyl resin particle dispersion liquid containing a releasing agent
(2) A crystalline polyester resin particle dispersion preparation step for preparing a crystalline polyester resin particle dispersion liquid by dissolving the crystalline polyester resin in an organic solvent, emulsified and dispersed in an aqueous medium, and removing the organic solvent
(3) A mixed dispersion liquid preparation step for preparing mixed dispersion liquid by adding a vinyl resin particle dispersion and a crystalline polyester resin particle dispersion to an aqueous medium
(4) An aggregated particle forming step for forming aggregated particles by heating the prepared mixed dispersion to aggregate the vinyl resin particles and the crystalline polyester resin particles (5) A ripening step for obtaining toner mother particles by ripening the formed aggregated particles with thermal energy to control the shape
(6) A cooling step for cooling the dispersion liquid of the toner mother particles
(7) A filtration and washing step for filtering toner mother particles from an aqueous medium and removing the surfactant from the toner mother particles
(8) A drying step for drying the washed toner mother particles
(9) An external additive adding step for adding an external additive to the toner base particles Here, the aqueous medium is one containing at least 50 mass % or more of water. As a component other than water, for example, an organic solvent soluble in water may be mentioned. Examples thereof include: methanol, ethanol, isopropanol, butanol, acetone, methyl ethyl ketone, dimethylformamide, methylcellosolve, and tetrahydrofuran. Among them, alcohol-based organic solvents such as methanol, ethanol, isopropanol, and butanol, which are organic solvents that do not dissolve the resin, are preferably used. Preferably, only water is used as the aqueous medium.

Conventionally known knowledge can be appropriately referred to when carrying out each step described above. For example, the above-mentioned vinyl resin particle dispersion and crystalline polyester resin particle dispersion cart be prepared by various emulsification methods such as a method of emulsifying by mechanical shearing force. However, it is preferable to prepare them using a method called a phase inversion emulsification method. In particular, with respect to the crystalline polyester resin particle dispersion, it is possible to uniformly disperse oil droplets by changing the stability of the carboxyl group of the polyester, by using a phase inversion emulsification method. It is superior in that it does not forcibly disperse by imparting shearing force as in the mechanical emulsification method.

The phase inversion emulsification method including the steps of: a dissolving step of dissolving a resin in an organic solvent to obtain a resin solution; a neutralizing step of charging a neutralizing agent into the resin solution; an emulsification step of emulsifying and dispersing the neutralized resin solution in an aqueous dispersion medium to obtain a resin emulsion; and a solvent removal step for removing organic solvent from the resin emulsion. Through these steps, a resin particle dispersion is obtained. The particle size of the resin particles in the dispersion may be controlled by changing the addition amount of the neutralizing agent.

Further, by using the toner mother particles as a core and providing a shell layer on the surface thereof, toner mother particles having a core-shell structure may be obtained. By adopting the core-shell structure, it is possible to further improve heat-resistant storage property and low-temperature fixing property. In order to produce the toner mother particles having a core-shell structure, it may be cited the following method, for example. After the aggregated particle forming step, this method contains the step of adding a shell particle forming resin particle dispersion containing vinyl resin particles to a mixed dispersion and forming a shell layer on the surface of aggregated particles as core particles.

The vinyl resin particles in the step of preparing the vinyl resin particle dispersion may have a multilayer structure of two or more layers having different composition of each layer. The dispersion of vinyl resin particles having a multilayer structure may be obtained by a multi-stage polymerization reaction. For example, a dispersion liquid of vinyl resin particles having a two-layer structure can be obtained by preparing a dispersion of vinyl resin particles by polymerization (first stage polymerization) of a vinyl monomer, thereafter, further adding a polymerization initiator and a vinyl monomer to polymerize it (second stage polymerization).

The external additive adding step is a step of preparing toner particles by adding and mixing external additive particles to the dried toner mother particles. As a method of adding the external additive, a dry method in which an external additive is added as a powder to the dried toner mother particles may be cited. As a mixing device, a mechanical mixing device such as a Henschel mixer and a coffee mill may be mentioned.

«Two-component Developer For Developing Electrostatic Image»

The toner according to the present invention may be used as a magnetic or nonmagnetic one-component developer, but it may be mixed with a carrier and used as a two-component developer.

As the carrier, for example, magnetic particles made of a conventionally known material: metals such as iron, ferrite, magnetite; and an alloy of these metals with aluminum or lead may be used. Ferrite particles are particularly preferable. As the carrier, a coated carrier in which the surface of magnetic particles is coated with a coating agent such as a resin, or a dispersed carrier obtained by dispersing magnetic fine particles in a binder resin may be used.

It is preferable that the carrier particles have a volume-based median diameter in the range of 10 to 100 μm, more preferably in the range of 20 to 80 μm. The volume-based median diameter of the carrier particles may be measured by a laser diffraction particle size analyzer "HELOS" (manufactured by SYMPATEC GmbH) including a wet dispersion device.

It is possible to obtain a two-component developer by mixing the toner particles and the carrier particles with a mixing apparatus. Examples of the mixing apparatus include: a Henschel mixer, a Nauta mixer, a Double cone mixer, and a V mixer.

The content of the toner in the two-component developer is preferably in the range of 1 to 10 mass % with respect to the total 100 mass % of the carrier and the toner.

Although the embodiments of the present invention have been described and illustrated in detail, the disclosed embodiments are made for purpose of illustration and example only and not limitation. The scope of the present invention should be interpreted by terms of the appended claims.

EXAMPLES

The present invention is specifically described with reference to the examples in the following. However, the present invention is not limited to these examples. In the examples described below, "parts" or "%" is used in the description, and it represents "mass parts" or "mass %" respectively unless specific notice is given.

«Preparation of Crystalline Polyester Resin Particle Dispersion Liquid (CP)»

Into a 5 L reaction vessel equipped with a stirrer, a temperature sensor, a cooling tube and a nitrogen introducing device, 281 mass parts of tetradecanedioic acid and 206 mass parts of 1,6-hexanediol were charged. While stirring the mixture, the inner temperature of the reaction vessel was raised to 190° C. over 1 hour. After confirming that the mixture was in a uniformly stirred state, 0.003 mass % of Ti(OBu)4 as a catalyst was added with respect to 100 mass % of the loaded 1,6-hexanediol. Thereafter, the internal temperature was raised from 190° C. to 240° C. over 6 hours while distilling off the produced water. Thereafter, the polymerization was carried out by continuing the dehydrating condensation reaction at a temperature of 240° C. over 6 hours to obtain a crystalline polyester resin. The number average molecular weight (Mn) of the crystalline polyester resin was 4,400.

30 mass parts of the above-described crystalline polyester resin were melted, and the resin in the melted state was transferred to an emulsifying disperser "Cavitron CD1010" (manufactured by Eurotec) at a transfer rate of 100 mass parts per minute. Currently with the transfer of the crystalline polyester resin in the melted state, a dilute ammonia solution having a concentration of 0.37 mass % was transferred to the emulsifying disperser at a transfer rate of 0.1 L per minute while heating to 100° C. with a heat exchanger. The dilute ammonia solution was prepared in an aqueous solvent tank by diluting a reagent ammonia water (70 mass parts) with ion-exchanged water.

The emulsifying disperser was operated under conditions of a rotation rate of the rotor of 60 Hz and a pressure of 5 kg/cm$^2$ (490 kPa) to prepare a crystalline resin particle dispersion liquid (CP) containing having a volume-based median diameter ($D_{50}$) of 300 nm and a solid content of 25 mass %.

«Preparation of Wax-containing Styrene-acrylic Resin Particle Dispersion Liquid (SA1)»

Into a reaction vessel equipped with a stirrer, a temperature sensor, a temperature controlling device, a cooling tube and a nitrogen introducing device, an anionic surfactant solution prepared by previously dissolving 2.0 mass parts of an anionic surfactant "sodium lauryl sulfate" in 2900 mass parts of ion exchanged water was charged. While stirring it at a stirring speed of 230 rpm under a nitrogen flow, the inner temperature of the reaction vessel was raised to 80° C. To this surfactant solution were added 9.0 mass parts of potassium persulfate (KPS) as a polymerization initiator. The inner temperature of the reaction vessel was raised to 78° C. A monomer mixture composed of the following was added thereto dropwise over 3 hours. After completion of the dropwise addition, polymerization (first stage polymerization) was carried out by heating and stirring at 78° C. for 1 hour to prepare a dispersion liquid of resin particles [a1].

Styrene: 540 mass parts
n-Butyl acrylate: 270 mass parts
Methacrylic acid: 65 mass parts
n-Octyl mercaptan: 17 mass parts In a flask equipped with a stirrer, 51 mass parts of ester wax (WEP-3, manufactured by NOF CORPORATION, melting point: 76° C.) as a releasing agent was added to a solution consisting of the following components. The mixture was heated to 85° C. and dissolved to prepare a monomer solution [2].

Styrene: 94 mass parts
n-Butyl acrylate: 60 mass parts
Methacrylic acid: 11 mass parts
n-Octyl mercaptan: 5 mass parts Here, a surfactant solution in which 2 mass parts of an anionic surfactant "sodium lauryl sulfate" were dissolved in 1100 mass parts of ion-exchanged water was heated to 90° C. To this surfactant solution, the above-mentioned dispersion liquid of resin particles [a1] was added so that the resin particles [a1] were 28 mass parts in terms of solid content. Thereafter, the above-mentioned monomer solution [2] was mixed and dispersed for 1 hour by using a mechanical disperser with a circulation route "CLEARMIX" (M Technique Co., Ltd.) so that a dispersion liquid containing emulsion particles having a dispersed particle size of 350 nm was prepared.

To the dispersion liquid was added an aqueous initiator solution prepared by dissolving 2.5 mass of a polymerization initiator "KPS" in 110 mass parts ion-exchanged water. This system was heated and stirred at 90° C. for 2 hours, whereby polymerization (second stage polymerization) was performed to prepare a dispersion liquid of resin particles [a2].

To the prepared dispersion liquid of resin particles [a2] was added an aqueous initiator solution prepared by dissolving 2.5 mass of a polymerization initiator "KPS" in 110 mass parts ion-exchanged water. Under the temperature condition of 80° C., a solution consisting of the following components was added dropwise over 1 hour. After completion of the dropwise addition, polymerization (third stage polymerization) was carried out by heating and stirring for 3 hours. Thereafter, the mixture was cooled to 28° C. to prepare a wax-containing styrene-acrylic resin particle dispersion liquid (SA1) in which wax-containing styrene-acrylic resin particles were dispersed in an anionic surfactant solution. The wax content was 9.8 mass % based on 100 mass parts of the wax-containing styrene-acrylic resin.

Styrene: 230 mass parts
n-Butyl acrylate: 100 mass parts
n-Octyl mercaptan: 5.2 mass parts «Preparation of Wax-Containing Styrene-Acrylic Resin Particle Dispersion Liquid (SA2)»

A wax-containing styrene-acrylic resin particle dispersion liquid (SA2) was prepared in the same manner as preparation of the above-described wax-containing styrene-acrylic resin particle dispersion liquid (SA1) except that the addition amount of the releasing agent during preparation of the monomer solution [2] was changed to 46 mass parts. The wax content was 8.8 mass % based on 100 mass parts of the wax-containing styrene-acrylic resin.

«Preparation of Wax-containing Styrene-acrylic Resin Particle Dispersion Liquid (SA3)»

A wax-containing styrene-acrylic resin particle dispersion liquid (SA3) was prepared in the same manner as preparation of the above-described wax-containing styrene-acrylic resin particle dispersion liquid (SA1) except that the addition amount of the releasing agent during preparation of the monomer solution [2] was changed to 48.1 mass parts. The wax content was 9.2 mass % based on 100 mass parts of the wax-containing styrene-acrylic resin.

«Preparation of Styrene-acrylic Resin Particle Dispersion Liquid (SA4)»

A styrene-acrylic resin particle dispersion liquid (SA4) was prepared in the same manner as preparation of the above-described wax-containing styrene-acrylic resin particle dispersion liquid (SA1) except that the releasing agent was not added during preparation of the monomer solution [2].

«Preparation of Colorant Particle Dispersion Liquid (Cy)»

90 mass parts of sodium lauryl sulfate were added to 1600 mass parts of ion-exchanged water. While stirring the solution, 420 mass parts of Copper phthalocyanine (C. I. Pigment Blue 15:3) were gradually added to the solution. Subsequently, by dispersion with a stirrer "CLEARMIX" (manufactured by M Technique Co., Ltd.), a colorant particle dispersion liquid (Cy) was prepared.

The volume-based median diameter of colorant particles contained in the colorant particle dispersion liquid (Cy) was 130 nm.

«Preparation of Toner 101»

Into a reaction vessel equipped with a stirrer, a temperature sensor and a cooling tube, 170 mass parts (in solid fraction) of the wax-containing styrene-acrylic resin particle dispersion liquid (SA1) and 2,000 mass parts of ion-exchanged water were charged. Thereafter, the pH was adjusted to 10 (at 25° C.) by adding 5 mol/L sodium hydroxide aqueous solution.

Thereafter, 24 mass parts (in solid fraction) of the colorant particle dispersion liquid (Cy) were added thereto. Then, while stirring, an aqueous solution of 80 mass parts of magnesium chloride dissolved in 80 mass parts of ion-exchanged water was added at 30° C. over a period of 10 minutes. After leaving it for 3 minutes, 20 mass parts (in solid fraction) of the crystalline polyester resin particle dispersion liquid (CP) were added over a period of 10 minutes. The temperature of the system was raised to 82° C. over a period of 60 minutes, and the temperature was held at 82° C. to allow the particle growth reaction to continue.

While keeping this condition, the particle size of the aggregated particles was measured by using a "Coulter Multisizer 3" (Beckman Coulter, Inc.). When the volume median particle size reached 4.7 μm, an aqueous solution of 100 mass parts of sodium chloride dissolved in 400 mass parts of ion-exchanged water was added to terminate the particle growth. Then, the reaction system was further heated and stirred at 74° C. to allow fusion of the particles to proceed. When the average circularity of the toner reached 0.961 measured with an image analyzer "FPIA-3000" (made by Sysmex Corporation) (HPF detection number: 4000), the reaction system was cooled to 30° C. at a cooling rate of 2.5° C./min.

Then, solid-liquid separation was carried out, and a dewatered toner cake was re-dispersed in ion-exchanged water. The pH value of the dispersion was adjusted to 3 by using a diluted hydrochloric acid, and solid-liquid separation was carried out. Thereafter, re-dispersion in ion-exchanged water was conducted again, and the toner cake was obtained. The cake was dried at 40° C. for 24 hours to yield toner mother particles.

To 100 mass parts of the obtained toner mother particles, 2.0 mass parts of hydrophobic silica (number average primary particle diameter: 12 nm, volume resistivity: $2.4\times10^{13}$) as an external additive s1, and 2.5 mass parts of hydrophobic titanium oxide (number average primary particle diameter: 30 nm, volume resistivity: $7.0\times10^{9}$) were added. The mixture was mixed at 20° C. for 20 minutes by using a "Henschel mixer" (Mitsui Miike Machinery Co., Ltd.) in the condition of a rotary blade circumferential speed of 40 mm/sec. Toner 101 was prepared by applying an external additive treatment to remove coarse particles using a sieve having an opening of 45 μm.

The Net intensity of the Group 2 element (magnesium) in the fluorescent X-ray analysis of the toner 101 was 3.92, and the Net intensity of the Group 1 element (sodium) was 0.51. The binder resin contained in the Toner 101 contains a vinyl resin in an amount of 40 mass % or more.

«Preparation of Toners 102 to 108»

Toners 102 to 108 were prepared in the same manner as preparation of the Toner 101 except that the amount and the type of the external additives s1 and s2 were changed as described in Table 1.

«Preparation of Toner 109»

Toner 109 was prepared in the same manner as preparation of the Toner 101 except that the particle size increase was stopped at the time when the volume-based median diameter became 7.0 μm at the particle growth reaction.

«Preparation of Toner 110»

Toner 110 was prepared in the same manner as preparation of the Toner 101 except that the particle size increase was stopped at the time when the volume-based median diameter became 7.2 μm at the particle growth reaction.

«Preparation of Toner 111»

Toner 111 was prepared in the same manner as preparation of the Toner 101 except that the styrene-acrylic resin particle dispersion liquid (SA4) was used instead of the wax-containing styrene-acrylic resin particle dispersion liquid (SA1).

<Preparation of Toner 112»

Toner 112 was prepared in the same manner as preparation of the Toner 101 except that the styrene-acrylic resin particle dispersion liquid (SA4) was used instead of the wax-containing styrene-acrylic resin particle dispersion liquid (SA1), and without adding the crystalline polyester resin particle dispersion liquid (CP).

<Preparation of Toner 113»

Toner 113 was prepared in the same manner as preparation of the Toner 101 except that the wax-containing styrene-acrylic resin particle dispersion liquid (SA3) was used instead of the wax-containing styrene-acrylic resin particle dispersion liquid (SA1), and without adding the colorant particle dispersion liquid (Cy).

<Preparation of Toner 114»

Toner 114 was prepared in the same manner as preparation of the Toner 101 except that after adding the colorant particle dispersion liquid (Cy), an aqueous solution of 45 mass parts of magnesium chloride dissolved in 45 mass parts of ion-exchanged water was added.

<Preparation of Toner 115»

Toner 115 was prepared in the same manner as preparation of the Toner 101 except that after adding the colorant particle dispersion liquid (Cy), an aqueous solution of 35 mass parts of magnesium chloride dissolved its 35 mass parts of ion-exchanged water was added.

<Preparation of Toner 116»

Toner 116 was prepared in the same manner as preparation of the Toner 101 except that particle growth was stopped by adding an aqueous solution of 40 mass parts of sodium chloride dissolved in 160 mass parts of ion-exchanged water.

<Preparation of Toner 117»

Toner 117 was prepared in the same manner as preparation of the Toner 101 except that particle growth was stopped by adding an aqueous solution of 35 mass parts of sodium chloride dissolved in 140 mass parts of ion-exchanged water.

«Preparation of Toner 118»

Toner 118 was prepared in the same manner as preparation of the Toner 101 except that the amounts of the external additives s1 and s2 were changed as described in Table 1.

«Preparation of Toner 119»

Toner 119 was prepared in the same manner as preparation of the Toner 101 except that the wax-containing styrene-acrylic resin particle dispersion liquid (SA2) was used instead of the wax-containing styrene-acrylic resin particle dispersion liquid (SA1), without adding the crystalline polyester resin particle dispersion liquid (CP), and the amounts of the external additives s1 and s2 were changed as described in Table 1.

TABLE I

| Toner No. | External additive s1 Kind | *1 | Volume resistivity (Ω · cm) | Added amount (mass parts) | External additive s2 Kind | *1 (nm) | Volume resistivity (Ω · cm) | Added amount (mass parts) | Content ratio with respect to the entire external additive (%) | Total added amount of external additive (mass parts) |
|---|---|---|---|---|---|---|---|---|---|---|
| 101 | Silica | 12 | $2.4 \times 10^{13}$ | 2.0 | Titania | 30 | $7.0 \times 10^{9}$ | 2.5 | 56 | 4.5 |
| 102 | Silica | 12 | $2.4 \times 10^{13}$ | 2.0 | Calcium titanate | 30 | $8.0 \times 10^{9}$ | 2.5 | 56 | 4.5 |
| 103 | Silica | 12 | $2.4 \times 10^{13}$ | 2.0 | Titania | 30 | $7.0 \times 10^{9}$ | 2.0 | 50 | 4.0 |
| 104 | Silica | 12 | $2.4 \times 10^{13}$ | 1.6 | Titania | 30 | $7.0 \times 10^{9}$ | 2.0 | 56 | 3.6 |
| 105 | Silica | 12 | $2.4 \times 10^{13}$ | 2.0 | Low resistivity silica | 30 | $4.0 \times 10^{10}$ | 2.5 | 56 | 4.5 |
| 106 | Silica | 12 | $2.4 \times 10^{13}$ | 3.15 | Titania | 30 | $7.0 \times 10^{9}$ | 1.35 | 30 | 4.5 |
| 107 | Silica | 12 | $2.4 \times 10^{13}$ | 3.2 | Titania | 30 | $7.0 \times 10^{9}$ | 1.3 | 29 | 4.5 |
| 108 | Silica | 12 | $2.4 \times 10^{13}$ | 4.5 | — | — | — | 0 | 0 | 4.5 |
| 109 | Silica | 12 | $2.4 \times 10^{13}$ | 2.0 | Titania | 30 | $7.0 \times 10^{9}$ | 2.5 | 56 | 4.5 |
| 110 | Silica | 12 | $2.4 \times 10^{13}$ | 2.0 | Titania | 30 | $7.0 \times 10^{9}$ | 2.5 | 56 | 4.5 |
| 111 | Silica | 12 | $2.4 \times 10^{13}$ | 2.0 | Titania | 30 | $7.0 \times 10^{9}$ | 2.5 | 56 | 4.5 |
| 112 | Silica | 12 | $2.4 \times 10^{13}$ | 2.0 | Titania | 30 | $7.0 \times 10^{9}$ | 2.5 | 56 | 4.5 |
| 113 | Silica | 12 | $2.4 \times 10^{13}$ | 2.0 | Titania | 30 | $7.0 \times 10^{9}$ | 2.5 | 56 | 4.5 |
| 114 | Silica | 12 | $2.4 \times 10^{13}$ | 2.0 | Titania | 30 | $7.0 \times 10^{9}$ | 2.5 | 56 | 4.5 |
| 115 | Silica | 12 | $2.4 \times 10^{13}$ | 2.0 | Titania | 30 | $7.0 \times 10^{9}$ | 2.5 | 56 | 4.5 |
| 116 | Silica | 12 | $2.4 \times 10^{13}$ | 2.0 | Titania | 30 | $7.0 \times 10^{9}$ | 2.5 | 56 | 4.5 |
| 117 | Silica | 12 | $2.4 \times 10^{13}$ | 2.0 | Titania | 30 | $7.0 \times 10^{9}$ | 2.5 | 56 | 4.5 |
| 118 | Silica | 12 | $2.4 \times 10^{13}$ | 1.0 | Titania | 30 | $7.0 \times 10^{9}$ | 0.6 | 38 | 1.6 |
| 119 | Silica | 12 | $2.4 \times 10^{13}$ | 1.8 | Titania | 30 | $7.0 \times 10^{9}$ | 0.5 | 22 | 2.3 |

*1: Number average primary particle diameter (nm)

«Image Forming Methods 101 to 119»

First, 100 mass parts of a ferrite core and 5 mass parts of cyclohexyl methacrylate/methyl methacrylate (copolymerization ratio 5/5) copolymer resin particles were charged into a high-speed mixer equipped with a stirring blade and they mixed by stirring at 120° C. for 30 minutes. A resin coating layer was formed on the surface of the ferrite core by the action of a mechanical impact force to obtain a carrier having a volume-based median diameter of 35 μm. The volume-based median diameter of the carrier may be measured by a laser diffraction particle size analyzer "HELOS" (manufactured by SYMPATEC GmbH) including a wet dispersion device.

The toners 101 to 119 prepared above were added to the resulting carrier so that the toner concentration was 6 mass %, respectively, and the resultant mixture was introduced into a micro type V mixer (Tsutsui Scientific Instruments Co., Ltd.). The mixture was mixed at a rotation speed of 45 rpm for 30 minutes to prepare developers 101 to 119.

A copying machine "bizhub PRESS™ C 1070" (manufactured by Konica Minolta, Inc.) was modified, and two developing units filled with the developer 101 were set at the magenta position and the cyan position, respectively. At that time, developing units were not set at the yellow position and the black position. On one surface of OK topcoated paper of A3 (manufactured by Oji Paper Co., Ltd., basis weight: 157 g/m$^2$, surface resistance value: $5.2 \times 10^{11}$ Ω) under normal temperature and normal humidity (temperature 20° C., humidity 50 % RH) was formed a solid image with a toner adhesion amount of 8 g/m$^2$. The solid image was fixed while the temperature of the pressure roller of a fixing unit was set at 70° C. to form an image (Image forming method 101).

Further, images were formed in the same manner as above using the developers 102 to 119 (image forming methods 102 to 119). The image surface resistance value at 70° C. according to the temperature change method of the image formed by each of the image forming methods 101 to 119 was measured by the above method. The values are indicated in Table II.

«Evaluation of Image Forming Methods 101 to 119»

The image cross section observation with the above image forming methods 104 and 114 is carried out and the following electrostatic adhesion evaluation is performed for each of the image forming methods 101 to 119.

(1) Observation of Image Cross Section

Fragments of each images formed by the image forming methods 104 and 118 are exposed for 1 minute in a ruthenium tetroxide ($RuO_4$) vapor atmosphere, and then the fragments are buried in a photocurable resin "D-800" (manufactured by JEOL Ltd.). Photocured blocks are formed by this.

Then, using a microtome provided with diamond cutter, a thin sample having a thickness of 60 to 100 nm is cut out from the formed block. This thin sample is placed on a grid with a support membrane for transmission electron microscope observation. A filter paper is put on a 5 cmφ plastic petri dish, and the grid having the section is placed on the plastic petri dish with the side on which the section is placed facing upward.

Then, using the vacuum electron dying apparatus VSC1R1 (manufactured by Filgen, Inc.), the above sections are stained with ruthenium tetroxide ($RuO_4$). According to the apparatus procedure, a sublimation chamber containing ruthenium tetroxide was installed in the main body of the dyeing apparatus, and after introducing the section into the dyeing chamber, it was placed under a condition of room temperature (24 to 25° C.), concentration 3 (300 Pa), for 10 minutes.

Figure 3A:
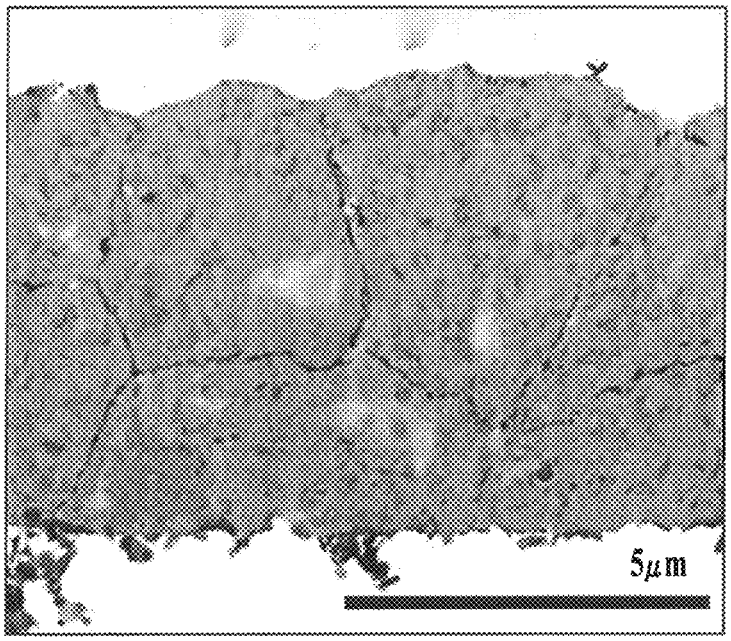
FIG. 3A is an electron micrograph of a section of an image formed by image forming method 104 in the Example.
Figure 3B:
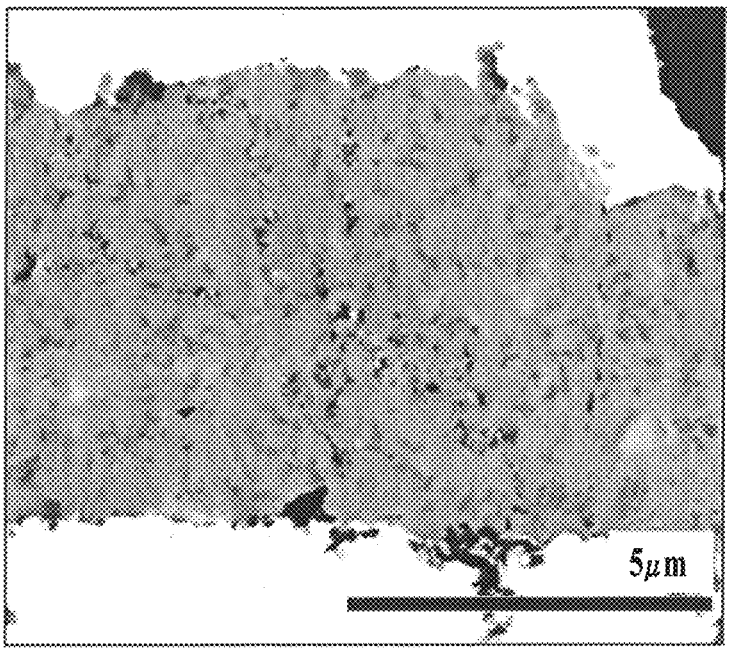
FIG. 3B is an electron micrograph of a section of an image formed by image forming method 118 in the Example.

Subsequently, using the scanning transmission electron microscope "JSM-7401F" (manufactured by JEOL Ltd.), under the conditions of an acceleration voltage of 30 kV, a magnification of 10000 times, and a bright field image, sections after dying (thickness: 60 to 100 nm) were observed. FIG. 3(*a*) illustrates a photographed image of a section of the image formed by the image forming method 104, and FIG. 3(*b*) illustrates a photographed image of a section of the image formed by the image forming method 118.

In the image formed by the image forming method 104 illustrated in FIG. 3(*a*), a conduction path extending from one side of the image layer to the other side can be confirmed. On the other hand, such a conduction path cannot be clearly confirmed in the image formed by the image forming method 118 illustrated in FIG. 3(*b*). Therefore, according to the image forming method 104, it can be said that an image having a conduction path can be formed.

(2) Evaluation of Electrostatic Adhesion

First, five image sheets were output in the double-side output mode by the image forming methods 101 to 119. On the output 5 sheets of paper bundle were placed 500 sheets of A3 Konica Minolta J paper. And they were left for 2 hours. Thereafter, the sheet bundle was placed on a flat table, a tape was affixed to the front end of the uppermost sheet, and the tape was slid slowly in the horizontal direction. At this time, the second and subsequent sheets from the top of the sheet bundle were fixed to the table so as not to move. The force required to slide the top sheet was measured with a spring balance. This operation was performed in order from the top to the fourth of the bundle of paper sheets, and the average value of the measured values was obtained. The calculated average values are shown in Table II. When the average value was 2.0 N or less, it was regarded as a practically feasible level.

TABLE II

| Image forming method No. | Toner No. | Toner mother particles: Volume-based median diameter (μm) | Toner mother particles: Content of wax (mass %) | Toner mother particles: *2 Colorant | Mg Net Intensity | Na Net Intensity | Image surface resistance value at 70° C. by temperature change method (Ω) | Electrostatic adhesion (N) | Remarks |
|---|---|---|---|---|---|---|---|---|---|
| 101 | 101 | 4.7 | 8.3 | 10 Present | 3.92 | 0.51 | $1.0 \times 10^{13}$ | 1.2 | Present invention |
| 102 | 102 | 4.7 | 8.3 | 10 Present | 3.92 | 0.51 | $1.3 \times 10^{13}$ | 1.3 | Present invention |
| 103 | 103 | 4.7 | 8.3 | 10 Present | 3.92 | 0.51 | $3.0 \times 10^{13}$ | 1.6 | Present invention |
| 104 | 104 | 4.7 | 8.3 | 10 Present | 3.92 | 0.51 | $5.0 \times 10^{13}$ | 1.9 | Present invention |
| 105 | 105 | 4.7 | 8.3 | 10 Present | 3.92 | 0.51 | $3.0 \times 10^{13}$ | 1.6 | Present invention |
| 106 | 106 | 4.7 | 8.3 | 10 Present | 3.92 | 0.51 | $3.2 \times 10^{13}$ | 1.6 | Present invention |
| 107 | 107 | 4.7 | 8.3 | 10 Present | 3.92 | 0.51 | $5.0 \times 10^{13}$ | 1.9 | Present invention |
| 108 | 108 | 4.7 | 8.3 | 10 Present | 3.92 | 0.51 | $4.0 \times 10^{13}$ | 1.7 | Present invention |
| 109 | 109 | 7.0 | 8.3 | 10 Present | 3.92 | 0.51 | $2.0 \times 10^{13}$ | 1.4 | Present invention |
| 110 | 110 | 7.2 | 8.3 | 10 Present | 3.92 | 0.51 | $5.0 \times 10^{13}$ | 1.9 | Present invention |
| 111 | 111 | 4.7 | — | 10 Present | 3.92 | 0.51 | $2.0 \times 10^{13}$ | 1.4 | Present invention |
| 112 | 112 | 4.7 | 8.3 | — Present | 3.92 | 0.51 | $3.0 \times 10^{13}$ | 1.6 | Present invention |
| 113 | 113 | 4.7 | 8.3 | 10 Absent | 3.92 | 0.51 | $3.0 \times 10^{13}$ | 1.6 | Present invention |
| 114 | 114 | 4.7 | 8.3 | 10 Present | 2.00 | 0.51 | $2.0 \times 10^{13}$ | 1.4 | Present invention |
| 115 | 115 | 4.7 | 8.3 | 10 Present | 1.90 | 0.51 | $4.5 \times 10^{13}$ | 1.8 | Present invention |
| 116 | 116 | 4.7 | 8.3 | 10 Present | 3.92 | 0.20 | $2.0 \times 10^{13}$ | 1.4 | Present invention |
| 117 | 117 | 4.7 | 8.3 | 10 Present | 3.92 | 0.19 | $4.5 \times 10^{13}$ | 1.8 | Present invention |
| 118 | 118 | 4.7 | 8.3 | 10 Present | 3.92 | 0.51 | $1.2 \times 10^{14}$ | 2.1 | Comparative example |
| 119 | 119 | 4.7 | 8.3 | — Present | 3.92 | 0.51 | $9.0 \times 10^{13}$ | 2.5 | Comparative example |

*2: Content of crystalline polyester resin (mass %)

As indicated in Table II, the image forming methods 101 to 117 exhibited lower values in electrostatic adhesion as compared with the image forming methods 118 and 119. Therefore, it can be said that the image forming methods 101 to 117 are capable of suppressing electrostatic adhesion between sheets after image formation.

What is claimed is:

1. An image forming method using an electrostatic image developing toner containing: toner mother particles including a binder resin; and an external additive, wherein the binder resin contains a vinyl resin in an amount of 40 mass % or more with respect to the total amount of the binder resin, the image forming method comprising a step of:

forming an image so that an image surface resistance value at 70° C. by a temperature change method of the formed image is set to be $5\times10^{13}$ Ω or less.

2. The image forming method described in claim 1, wherein a content of particles in the external additive having a number average primary particle diameter of 30 nm or less is 4 mass parts or more with respect to 100 mass parts of the toner mother particles.

3. The image forming method described in claim 2, wherein among the particles in the external additive having a number average primary particle diameter of 30 nm or less, a content of particles having a volume resistivity of $1\times10^{10}$ Ω·cm or less is in the range of 30 to 100 mass % with respect to the whole external additive having a number average primary particle diameter of 30 nm or less.

4. The image forming method described in claim 1, wherein the image surface resistance value is set to be $3\times10^{13}$ Ω or less.

5. The image forming method described in claim 1, wherein the toner mother particles have a volume-based median diameter in the range of 4 to 7 μm.

6. The image forming method described in claim 1, wherein the electrostatic image developing toner contains a crystalline substance.

7. The image forming method described in claim 6, wherein the crystalline substance contained in the electrostatic image developing toner is a crystalline polyester resin.

8. The image forming method described in claim 1, wherein the electrostatic image developing toner contains a colorant.

9. The image forming method described in claim 1, wherein the electrostatic image developing toner has a Net intensity of Group 2 element of 2.00 or more in the fluorescent X-ray analysis.

10. The image forming method described in claim 1, wherein the electrostatic image developing toner has a Net intensity of Group 1 element of 0.20 or more in the fluorescent X-ray analysis.

* * * * *